US006124584A

United States Patent [19]

Blaker et al.

[11] Patent Number: 6,124,584

[45] Date of Patent: Sep. 26, 2000

[54] MOISTURE MEASUREMENT CONTROL OF WOOD IN RADIO FREQUENCY DIELECTRIC PROCESSES

[75] Inventors: Glenn Craig Blaker, North Vancouver; Terry Albert Enegren, Vancouver; Gary Kenneth Kooznetsoff; Robert Lewis Zwick, both of Castlegar, all of Canada

[73] Assignee: HeatWave Drying Systems Inc, Crescent Valley, Canada

[21] Appl. No.: 09/335,844

[22] Filed: Jun. 18, 1999

[51] Int. Cl.[7] ..... H05B 6/50

[52] U.S. Cl. ..... 219/779; 219/770; 219/773; 73/29.01; 34/254

[58] Field of Search ..... 219/770, 773, 219/779, 777, 775; 34/250, 254, 255; 73/29.01, 29.05

[56] References Cited

U.S. PATENT DOCUMENTS 3,721,013 3/1973 Muller ..... 34/254
3,986,268 10/1976 Koppelman .
4,258,240 3/1981 Pless ..... 219/779
4,406,070 9/1983 Preston ..... 219/773
5,641,423 6/1997 Bridges et al. ..... 219/770

*Primary Examiner*—Philip H. Leung
*Attorney, Agent, or Firm*—C. A. Rowley

[57] ABSTRACT

A method of determining the moisture content of charge of wood having a moisture content below fiber saturation and being subjected to a Radio Frequency dielectric heating process to the degree required to control the process (e.g., terminate drying) by measuring the wood product package dimensions and monitoring the RF power KW and RF voltage KV being applied to the charge at the electrode(s) and further controlling (i.e., terminating) the process when the KW and KV being applied based on a pre-selected function indicates that the charge has reached a preselected moisture content.

20 Claims, 7 Drawing Sheets

Figure 2: Red Oak
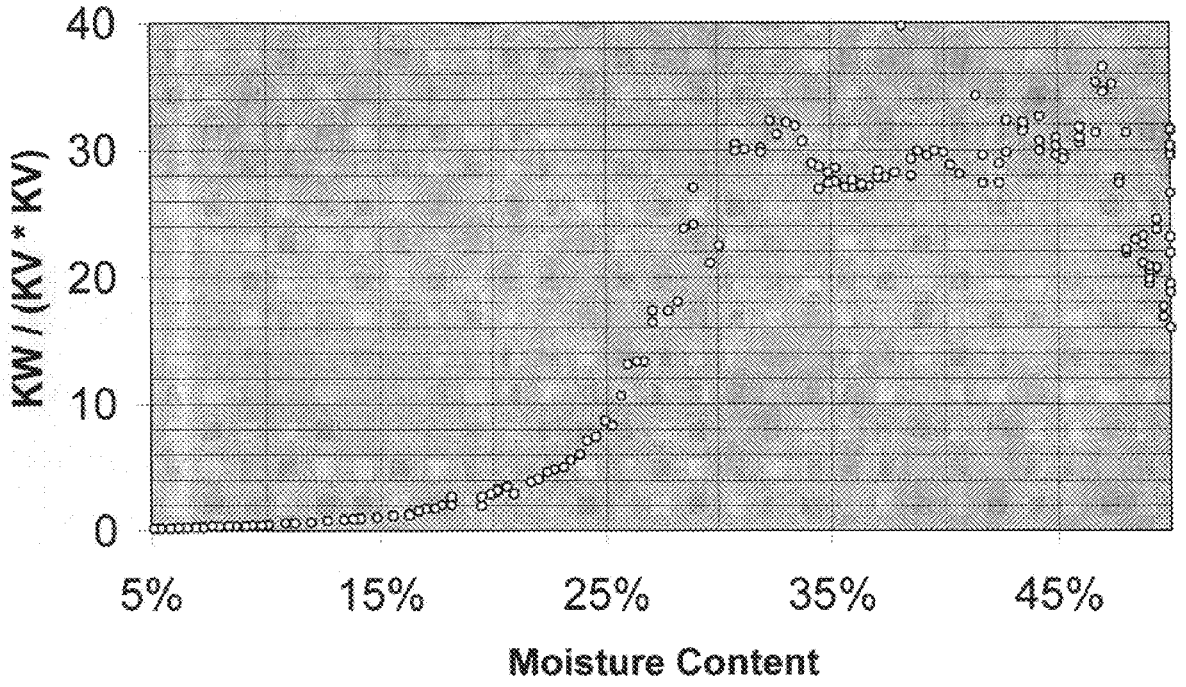

Figure 3: Red Oak (k1 = 12; k2 = -9)
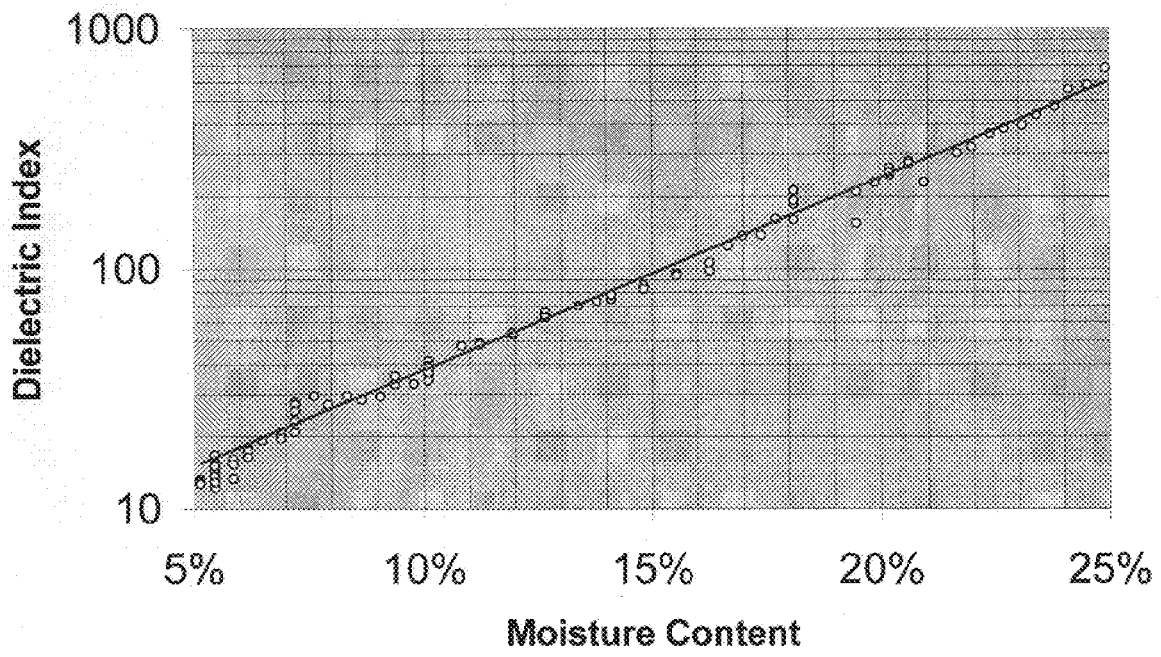

Figure 4: Paper Birch (k1 = 18; k2 = -20.5)
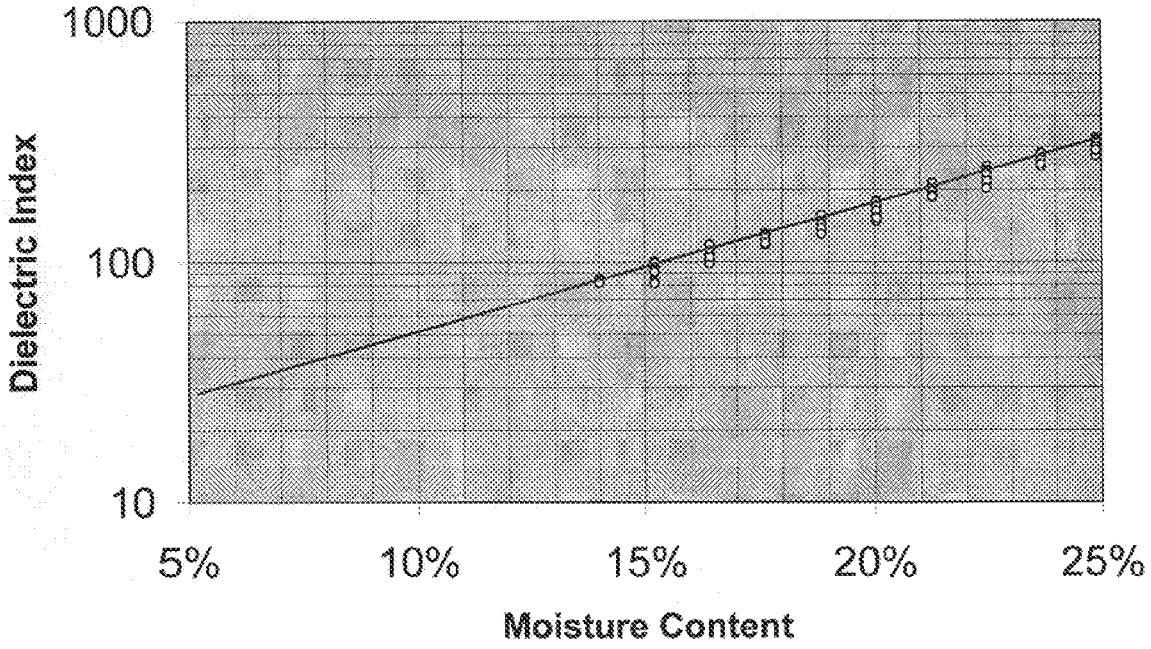

Figure 5: W. Hemlock (k1 = 19; k2 = -22)
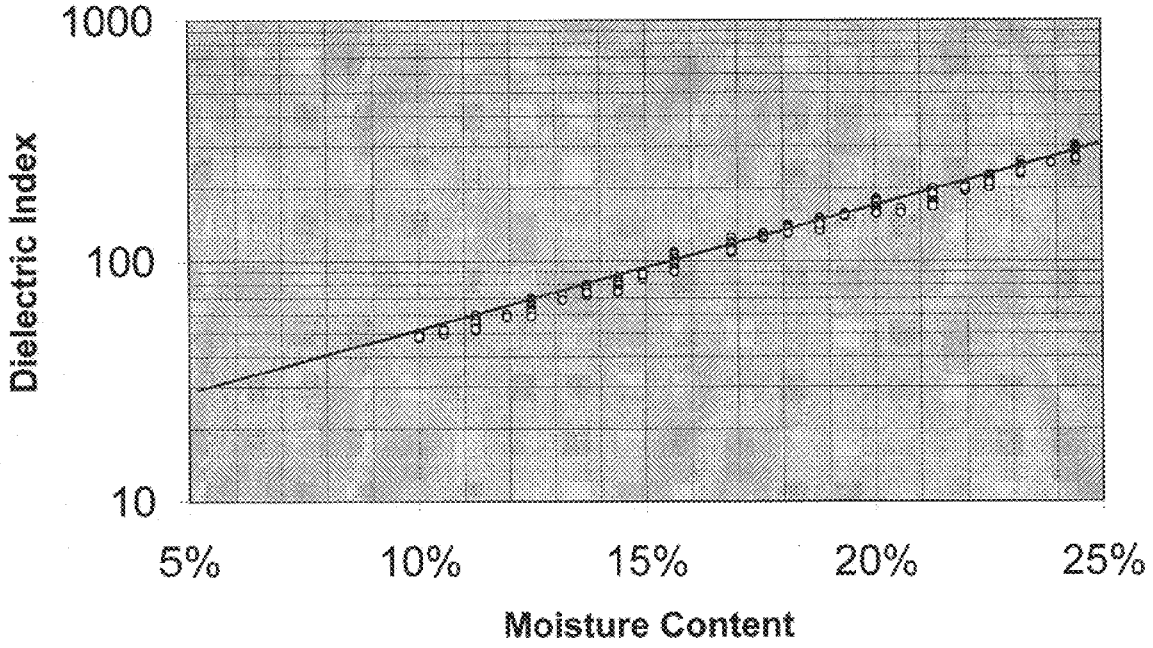

Figure 6: P. Pine (k1 = 34; k2 = -57)
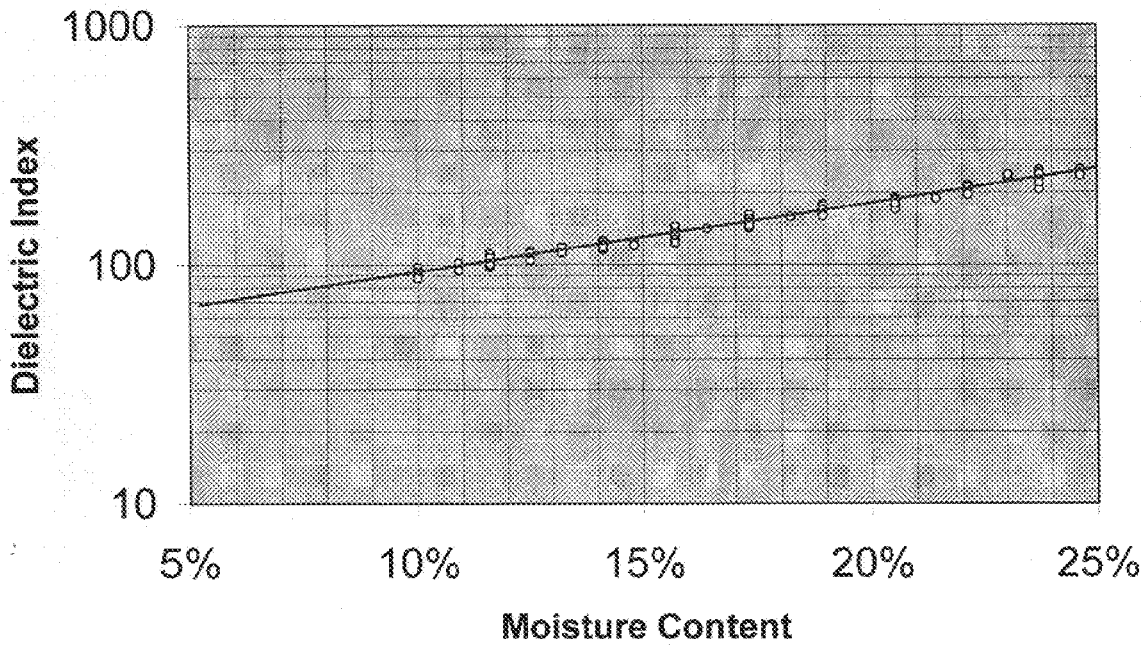

Figure 7: Loose P. Pine (k1 = 28; k2 = -39)
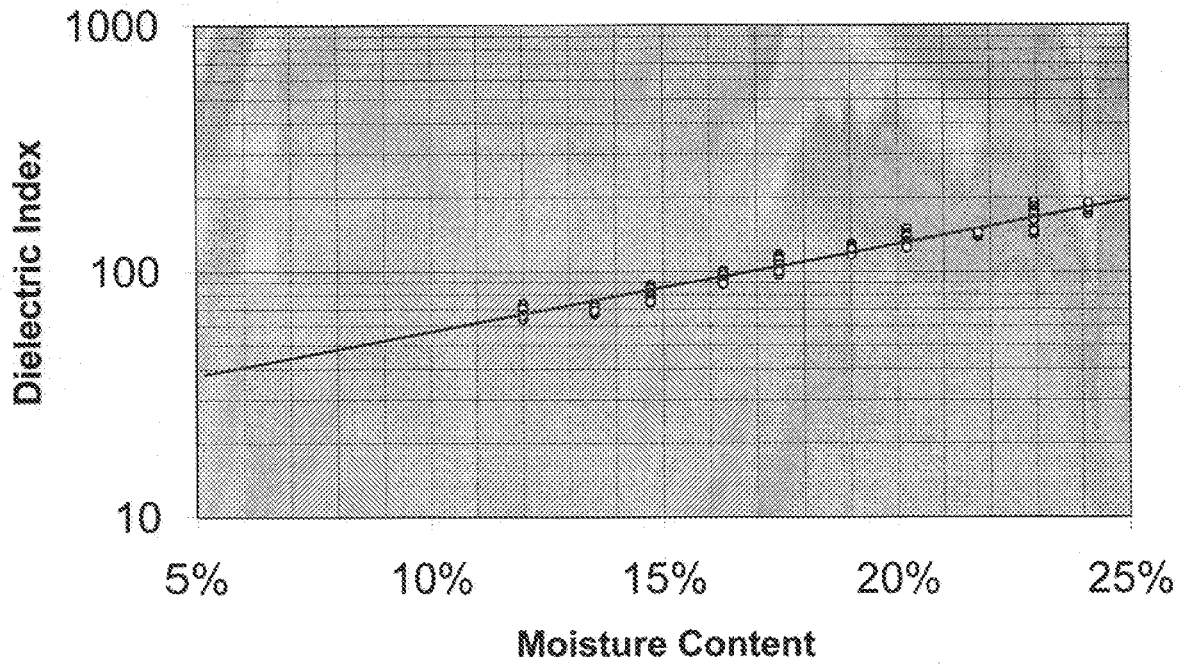

MOISTURE MEASUREMENT CONTROL OF WOOD IN RADIO FREQUENCY DIELECTRIC PROCESSES

FIELD OF INVENTION

The present invention relates to indirectly measuring the moisture content of wood products within a dielectric process; more particularly, the present invention permits accurate automated computer control to control the dielectric process cycle when the wood product reaches an operator-specified (preselected) moisture content.

BACKGROUND OF THE INVENTION

In dielectric drying systems particularly those for drying wood of the type described in U.S. Pat. No. 3,968,268 issued Oct. 19, 1976 to Koppelman, it is conventional practice to estimate the moisture content of the drying load by measuring the volume of water or condensate exiting the drying system (as mentioned by Koppelman). It is common for equipment of this type to operate in a nearly closed cycle where water extracted from the drying load is discharged from the bottom of the drying chamber and from a condensing system. Depending on the condensing system and changing operating conditions, a varying amount of unaccounted water vapor may be released into the environment.

Of greater concern, much larger moisture content measurement inaccuracies are introduced by not knowing with any great degree of certainty the initial moisture of the drying load. With wood products, the initial moisture contents of drying loads often have large variations which depend on a number of factors such as from where the wood was harvested, the time of year, the wood species, sapwood/heartwood differences, and how long the wood has been air drying prior to kiln drying. Given the inherent variability of wood products, it is clear that moisture content measurement using this current technique is full of uncertainty and inaccuracy.

BRIEF DESCRIPTION OF THE PRESENT INVENTION

It is an object of the present invention to provide an improved method for determining the moisture content of wood products in a dielectric heating process such as a dry kiln.

It is a further object of the present invention to provide a reliable moisture determining method that permits accurate computer control of the dielectric process cycle (such as process termination with wood drying.)

The present invention relates to a practical method of defining the moisture content of wood products having a moisture content (in % by oven-dry weight) in the range of from 5% to 25% being subjected to Radio Frequency Dielectric Heating (RFDH) comprising determining package size of a kiln charge of material by measuring its dimensions of package height h, package width w and package length l; subjecting said kiln charge to RFDH; measuring the RF power KW being applied in kilowatts (kW) to the charge through the electrode(s); measuring the RF voltage KV applied at the electrode(s) in kilovolts (kV); determining the moisture content MC as % moisture in the charge when subjected to the measured conditions of RF power, RF voltage, and package dimensions based on a function of measured values of KW, KV, and package dimensions.

Preferably the function of the measured values of KW, KV, w, h and l will be based on the relationships $$MC=k_1*f(DI)+k_2$$

and $$DI=KW*h/KV^2*l*w,$$

Where:

MC=Moisture content (in % by oven-dry weight),

KW=Measured RF power (in kW) being output from a radio frequency power generator to the electrode(s) and through the material.

KV=Measured RF voltage (in kV) at the electrode(s).

w=package width of material l=package length of material h=package height of material (more specifically, the distance between the electrode and electrical ground)

$k_1$ and $k_2$ are constants for a given material.

Preferably $f$(DI) is a logarithmic function.

Preferably $f$(DI) is a log 10 function.

The invention also broadly relates to a method of controlling the operation of a process for Radio Frequency Dielectric Heating (RFDH) a charge comprising measuring the size of said charge to determine its dimensions of height h, width w and length l subjecting the charge having a moisture content (in % by oven-dry weight) in the range of from 5% to 25% to RFDH, measuring the RF power KW being applied in kilowatts (kW) to the charge through electrode(s), measuring the RF voltage KV in kilovolts (kV) applied at the electrodes, and the process cycle when the moisture content MC (as a percent by oven-dry weight of the charge) reaches a preselected value $MC_S$ as determined based on said measured values KW, KV, package dimensions, and a predetermined function based on the measured values of KW, KV, and package dimensions.

Preferably said function is the equations $$MC_S=k_1*f(DI)+k_2$$

and $$DI=KW*h/KV^2*l*w$$

Where:

KW=Measured RF power (in kW) being output from a radio frequency power generator to the electrode(s) and through the material.

KV=Measured RF voltage (in kV) at the electrode(s).

w=package width of material l=package length of material h=package height of material (more specifically, the distance between the electrode and electrical ground)

$MC_S$=the preselected Moisture content (in % by oven-dry weight)

$k_1$ and $k_2$ are predetermined constants for the material of the charge being processed.

Preferably $f$(DI) is a logarithmic function.

Preferably $f$(DI) is a log 10 function.

The RFDH system can be operated with the charge subject to subatmospheric pressure.

BRIEF DESCRIPTION OF THE DRAWINGS

FIG. 2 is a plot for Red Oak of RF power (KW) applied to the charge in kW verses RF voltage applied to the charge in kV for a radio frequency drying system (RFDH).

FIG. 3 is the data of FIG. 2 plotted on log paper based on the equations $$MC=k_1*f(DI)+k_2$$

and $$DI=KW*h/KV^2*l*w$$

Figure 1:
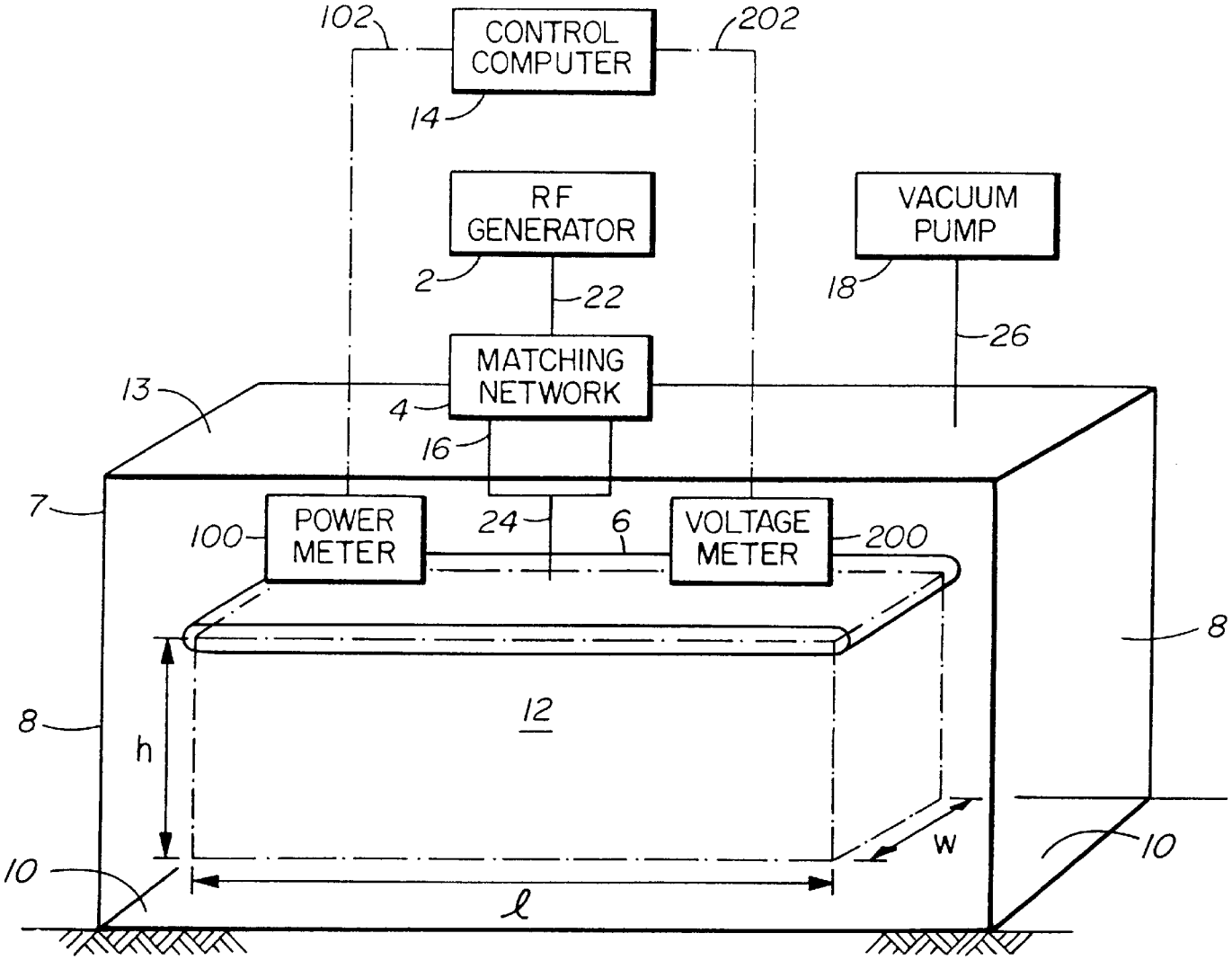
FIG. 1 is a schematic illustration of the components related to the moisture content measurement system of the present invention.

Where:

KW=Measured RF power (in kW) being output from the RF generator into the electrode(s) and through the material.

KV=Measured RF voltage (in kV) at the electrode(s).

w=package width of material measured in meters l=package length of material measured in meters h=package height of material (more specifically, the distance between the electrode and electrical ground) measured in millimeters MC=Moisture content (in % by oven-dry weight), F(DI)=a base 10 logarithmic function of KW and KV and $k_1$=12, $k_2$=−9, l=7.92 m, w=2.44 m, and h=1520 mm FIG. 4 is a plot similar to FIG. 3 but for the species Paper Birch ($k_1$=18; $k_2$=−20.5; l=6.10 m; w=2.44 m; and h=1220 mm).

FIG. 5 is a plot similar to FIG. 3 but for the species Western Hemlock ($k_1$=19; $k_2$=−22; l=8.53 m; w=2.44 m; and h=990 mm).

FIG. 6 is a plot similar to FIG. 3 but for the species Ponderosa Pine ($k_1$=34; $k_2$=−57; l=7.98 m; w=2.59 m; and h=1270 mm).

FIG. 7 is a plot similar to FIG. 6 for the species Ponderosa Pine but is shown for a drying package with air gaps (loosely packed) ($k_1$=28 and $k_2$=−39; l=5.03 m; w=2.44 m; and h=1270 mm).

DESCRIPTION OF THE PREFERRED EMBODIMENTS

Before describing the invention it detail, it is to be noted the term Radio Frequency (RF) as used throughout this specification in intended to define the use of power at frequencies in the radio frequency spectrum where the principles of this invention are valid for wood products in the frequency range normally used commercially (i.e. 3 MHz to 60 MHz).

In the Applicant's implementation of an RFDH system, electromagnetic energy is transferred to a load being dried from a Radio Frequency (RF) generator optionally through a matching network and then to an electrode in contact with the drying load. Moisture determination using the present invention i.e. in RFDH is valid at the frequencies normally used in commercial applications of RFDH, namely between 3 to 60 MHz in the radio frequency (RF) range and most relevant for wood products ranging in moisture content (in % of oven-dry weight) from 5% to 25% although the Applicants have found that one can extend the useful MC range of the invention for some wood products.

As heat is being applied to the load in a dielectric kiln and its moisture content decreases, a dielectric property of the drying product, its loss factor, is known to change. It is known to the art that each product has a unique moisture content—loss factor relationship that could be determined empirically. While the product is being heated by the dielectric heating method, to applicant's knowledge, no known methods of directly measuring the loss factor currently exist; however, the Applicants found through experimentation that the loss factor can be inferred with a high degree of accuracy as will be described in greater detail below. Fortunately, the Applicants then empirically found a general-form moisture content—loss factor function valid:

for most if not all wood species, over the most practically important moisture content ranges for commercial wood processing applications i.e. 5% to 25% moisture, and for a frequency range that is of greatest industrial importance for dielectric wood processing in the RF spectrum i.e. frequencies in the range of about 3 to 60 MHz.

The present invention discloses a method to indirectly, but relatively accurately, measure the moisture content of the wood products in a dielectric heating process and incorporates this method into the overall dielectric control strategy (such as in a dry kiln, for example to define an accurate termination point of the process cycle based on moisture content. This lends itself to computer control of the dielectric heating/drying process.)

As illustrated in FIG. 1, the system of the present invention preferably includes a heating or drying chamber 7 or kiln in the form of a vacuum type chamber 7 in that the interior of the chamber 7 may be connected as indicated by a line 26 to a vacuum pump or the like 18 that produces negative pressure, i.e. pressure below atmospheric pressure within the interior of the chamber 7 once the chamber 7 is sealed as common for these types of heating or drying systems. Typically when operating at subatmospheric pressure, the pressure in the chamber 7 will be between 30 millimeters(mm)mercury(Hg) and 75 mmHg.

During the drying cycle, electromagnetic energy is transferred to a drying load or charge schematically represented by the dotted box 12, from a radio frequency (RF) generator 2, through a transmission line 22, optionally through a matching network 4, optionally through more transmission line (not shown), through one or more feedthroughs 16 passing through the shell of the chamber 7, through one or more connection cables 24, and then to an electrode 6 in contact with the drying load 12.

Under specific conditions discussed below, the applicant has found determining MC through the product's loss factor to be ideally suited for wood products. It is known to the art that the product's loss factor in an RFDH system is direct function of:

$$\frac{\text{(RF power output from the RF generator)}}{\text{(operating RF frequency)}*\text{(RF voltage measured at the electrode)}^2}$$

As the Applicant employs fixed frequency RF generators known as RF amplifiers in its implementation, the frequency variable is eliminated completely from this function. Although as long as the RF frequency is measured and factored out of the above equations, a non-fixed frequency RF generator known as an RF oscillator can also accurately use this invention.

The accurate measurement of loss factor in RFDH applications requires a consistent interaction of the electromagnetic fields during the process. From a practical perspective in industry, this inconsistent interaction of electromagnetic fields was experimentally found to be critically important meaning that the geometry of the load must be carefully considered when using this invention. For instance, increasing the number of spaces within the load or wood products or extending boards beyond the package as a whole introduces a greater number of errors measuring the loss factor to the point where inconsistent loading can lead to unacceptably high level of errors in moisture content determine by the present invention. Although the greatest accuracy in determining loss factor is achieved with a preferred solid block "cube" package in this invention, acceptable accuracy can also be achieved if consistent package geometry is used from one process batch to the next process batch. For example, one of the practical applications of an RFDH system is to process round wood poles; although given the geometry of poles, there is no way of packaging round poles into a solid cube without any holes between adjacent poles. Fortunately, the non-ideal electromagnetic field interactions between similar packages of round wood have been shown to be reproducible between drying runs and therefore it is acceptable to use this invention to obtain the required degree of accuracy as long as unique $k_1$ and $k_2$ constants are calculated for those particular type of products (as will be discussed and shown in figures below).

Additional inaccuracies can be introduced with errors in the accuracy of measuring the RF voltage KV and the RF power KW. Accuracy can be limited by the physical dryer environment, specifically all electrical grounding within the chamber 7, the geometry and size of the drying chamber including the electrode 6, feedthroughs 16, connection cables 24, containing chamber walls/doors 8, chamber floor 10, chamber roof 13, etc. Fortunately, such inaccuracies do not limit the capability of this moisture-determining invention. Even with these inaccuracies, MC determining can be empirically tuned rendering the inaccuracies insignificant (as discussed below in greater detail) and the results would be sufficiently accurate and reproducible for that unique system (as long as the inaccuracies remain constant from batch to batch). However, such inaccuracies between systems would limit the ability of directly transferring data and control schedules such as drying stop schedules from one system to another system.

With the above conditions understood, the loss factor of each individual species of wood product is known to be a function of:

- the average moisture content;
- the wood density;
- RF frequency;
- the average temperature;
- the orientation of the electromagnetic fields with respect to the orientation of the wood grain; and
- and the chemical composition of the products (i.e., additional sea water penetrated)

Fortunately in most implementations, i.e. for practical purposes and for the great majority of wood that will be processed for example in a wood dry kiln, it was discovered that all factors outside of the moisture content could be ignored and that the moisture content could be isolated from the loss factor. Most importantly, a method of determining moisture content was demonstrated to be independent of batch to batch variances in initial moisture content of drying loads or at the rate that moisture was being removed.

Before subjecting a charge to the drying operation it is necessary to determine the dimensions of the charge namely its height h (distance between the electrodes) width w measured across the charge i.e most commonly, perpendicular to the grain direction and length l (most commonly this dimension is parallel to the grain). The charge is most commonly arranged with its grain (assuming wood is being dried) perpendicular to the height h. Most typical RFV applications require that the h direction be perpendicular to the grain and with w and l which obviously are mutually perpendicular, although as mentioned below, length l does not necessarily parallel to the grain i.e. in the case of drying very short trim ends, the packages can have criss-crossed grain within a drying package in the l and w direction.

Thus as is apparent if the units of the dimensions measured are changed the values of the constants $k_1$ and $k_2$ as will be described below will change accordingly so the values of these will be different depending on whether metric, British, cm, m or feet yards or inches etc are used when measuring the package. The general form of the equation still holds for any selected units for any of the measured items in the equation(s). The key is to be consistent to chosen units when calculating $k_1$ and $k_2$. Applicant prefers to measure length l and width w in meters and h in millimeters as this generally results in values of $k_1$ and $k_2$ that are not very small and for that reason the following disclosure will describe the process whit length l and width w measured in meters and h in millimeters.

When using the invention to determine moisture content and/or control the termination of the drying cycle under typical dielectric drying conditions, the temperature of the drying load typically remains nearly constant once heated up to typical drying temperatures which permits temperature to be eliminated from the moisture determining function. It would be reasonable to expect that by analyzing the data for loss factor vs. temperature for different wood species, temperature compensation for RFDH applications can be achieved where the operating temperatures of the process is not constant.

The RFDH system can be operated with the charge subject to subatmospheric pressure and still employ the present invention.

In a specific implementation of the invention, the Applicant used standard 50 ohm RF amplifier technology which not only ensures the RF frequency remains constant but allows the output RF power from the RF generator to be easily measured. To carry out the present invention, the specific implementation described above is provided with a standard RF power measuring device known as a watt meter as indicated schematically at 100 and a standard RF voltage measuring device as indicated at 200 which are connected to the control computer 14 to transmit their readings thereto via lines 102 and 202 respectively. There are no unique requirements outside of what is commonly known in the art for the instrumentation to measure RF voltage or RF power. In the case of RF oscillators where a "matched line" (i.e. 50 ohm, 75 ohm, etc.) between the RF generator and the electrode is generally not used, measuring RF power is much more difficult and is known to introduce a higher level of error into this invention. With a 50 ohm line for instance, the matching network 4 compensates for the changing load impedance so that the RF amplifier 2 always sees 50 ohms. Without a matched line, a watt meter cannot be used and those skilled in the art rely on indirectly measuring RF power by monitoring internal voltages and currents within the RF generator (i.e., plate current, grid bias voltage and current, tube losses, operating frequency, etc.) and then use standard equations known to the art to approximate the RF power output. Although accurate RF power measurement is important to this invention, no limit is placed on the method that this can be accomplished.

For all the above stated reasons, the preferred RF generator 2 for this invention is an RF amplifier 2 preferably with a standard 50 ohm impedance although this invention is not limited to the selection of the type of RF generator 2 or to a specific design using 50 ohm technology. The present invention is based on the findings that the moisture content of a charge being dried has a specific relationship to the RF power and RF voltage applied to the charge or load through the electrode.

Shunt resistance ($R_{SHUNT}$) is defined:

$$R_{SHUNT}=V^2/(2P)$$

Where for this invention:

P=The RF power magnitude applied to the volume of wood contained between two electrodes.

V=The voltage developed across the electrodes.

The corresponding shunt conductance ($G_{SHUNT}$) is the reciprocal of the shunt resistance $$G_{SHUNT}=1/R_{SHUNT}$$

It has been observed and measured that the moisture content can be expressed as a linear function of the logarithm of $G_{SHUNT}$.

This relationship of moisture content to the RF power and RF voltage applied to the charge or load through the electrode has been found to be defined within the required accuracy by the equations $$MC=k_1*f(DI)+k_2$$

and $$DI=KW*h/KV^2*l*w \quad (2)$$

Where:

KW=Measured RF power (in kW) being output from the RF generator_2 through the electrode(s) 6 and through the material 12. Depending on the choice of RF generator technology, a matching network and/or matched line may be employed between the RF generator and the electrode (in either case, the use of a matching network and/or matched line is irrelevant for the purpose of this invention.)

KV=Measured RF voltage (in kV) at the electrode(s) 6.

w=package width of material measured in meters l=package length of material measured in meters, h=package height of material (more specifically, the distance between the electrode and electrical ground) measured in millimeters and is always perpendicular to the grain when wood is being dried, MC=Moisture content (in % by oven-dry weight), and In the preferred system the function $f(DI)$ is a log 10 function.

With this system, the constants $k_1$ and $k_2$ must be determined for each of the wood species to be processed. The procedure to obtain these values includes measuring the moisture content under several different operating conditions with different values of KW and KV and then solving e.g. by simultaneous equation solving techniques to find the values of constants $k_1$ and $k_2$.

As discussed above, the loss factor is influenced by frequency; therefore the MC function is also related to the frequency being used. The influence of RF frequency may be ignored all together in systems that use a fixed-frequency generator. However, if one were to use different RF frequencies (as is a real possibility for a different sized system), one would have to collect new data (and new $k_1$ and $k_2$ constants). It is believed that it would be reasonable to expect that a general form of conversion formula of all $k_1$ and $k_2$ data could be found that would convert all $k_1$ and $k_2$ from one frequency to another by analyzing the data functions and then mathematically determining what mathematical function best converts the data in the general form.

As discussed above, the MC function is also temperature-related. As the implementation to RF drying in the examples below operates at pretty much a constant temperature, the influence of temperature may be ignored once the wood reaches operating temperature after initially heating the wood. Initially, during the warm-up stage of the drying product, the data does not follow the specified function although as indicated above, the Applicant believes it would be reasonable to expect that the temperature change could be compensated for if required.

It will be apparent that in applying the present invention, the system may be controlled by simply basing it on the measured KW and KV in process (assuming the size of the charges is normally substantially constant), without ever actually calculating the moisture content (MC) i.e. the value at which drying should stop could be determined by trial and error to establish a "magic number" composed of some function of KW and KV and this "magic number" used as the set point for controlling the turn off time for future similar loads being dried i.e to define a preselected moisture content $MC_S$. In other words, any suitable function based on KW and KV for example (a function of (KV*KV)/KW) may be used to define an empirically found magic number that indicates that the wood is finished drying and when the applied conditions generate this so found empirical value (that is very indirectly related to moisture content) the drying is stopped. In wood drying, the typical wood mill doesn't care about the general form of the equations—they are more interested in stopping the wood drying at an average moisture content of 10% (or 8%, etc.) for their product—W. Hemlock for instance. By carefully following the constraints of this control strategy, it is clear how one skilled in the art can teach an RFDH system to control a moisture dependent process with a single "number" based of KW and KV.

In the specific examples given below and shown in the following Figures, the frequency employed was a normal commercially-used frequency of 6.78 MHz.

FIG. 2 shows a typical plot of $KW/KV^2$ for Red Oak plotted from measurements of moisture content in % by oven-dry weight of the charge at various applications of energy KW in kW and RF voltage KV in kV as applied to the load. It is apparent that the this plot could not provide a reasonable basis for determining the moisture content of the load at a specific operating condition, however when the same results are plotted on log 10 paper based on Equations 1 and 2 above as shown in FIG. 3, a reasonably straight line curve emerges and the constants $k_1$ and $k_2$ may be determined and then applied to other RF power KW and RF voltage KV applications to calculate MC. In this case, the value for $k_1$ was determined to be 12 and $k_2$ to be −9 i.e. $k_1$=12 and $k_2$=−9 (data collected for packages with dimensions: l=7.92 m; w=2.44 m; and h=1520 mm).

In making the plots, the final moisture contents were measured to determine average moisture content using hand-held moisture meters specifically for wood. Greatest accuracy for this invention is achieved when the average moisture contents of the wood prior to drying are also carefully measured (i.e., using weigh scales before and after drying as the accuracy of hand-held meters is very often limited at much higher initial moisture contents). The MC scale (x axis) is composed of those two end points with the intermediate MC's scaled to the measurements of how much water is being dumped out of the process while operating. The losses in collecting water were minimal but nonetheless, assumed to be constant throughout the entire drying cycle.

FIGS. 4, 5 and 6 show the results when plotted on log base 10 paper for Paper Birch, W. Hemlock, and Ponderosa Pine respectively and the values of the constants were found to be;

| | | |
|---|---|---|
| FIG. 4 | Paper Birch | $k_1$ = 18 and $k_2$ = −20.5 (l = 6.10 m; w = 2.44 m; and h = 1220 mm). |
| FIG. 5 | W. Hemlock | $k_1$ = 19 and $k_2$ = −22 (l = 8.53 m; w = 2.44 m; and h = 990 mm). |
| FIG. 6 | Ponderosa Pine | $k_1$ = 34 and $k_2$ = −57 (l = 7.98 m; w = 2.59 m; and h = 1270 mm). |

FIG. 7 illustrates the effect of inconsistent interaction of electromagnetic fields. Specifically, a number of Ponderosa Pine drying runs were completed that all had consistent spaces throughout the otherwise solid cube pack (approximately 20% spaces or air gaps). Although all these batches all closely followed the calculated $k_1$ an $k_2$ constants shown in FIG. 7, these constants differed drastically with $k_1$ and $k_2$ constants calculated for batches of solid packed (0% spaces) Ponderosa Pine illustrated in FIG. 6. This illustrates that as long as there are consistent interactions of the electromagnetic fields from batch to batch (not necessarily near-perfect interactions as with perfect cube-shaped loads), this invention is still clearly valid and useful.

| | | |
|---|---|---|
| FIG. 7 | Ponderosa Pine (loose) | $k_1$ = 28 and $k_2$ = −39 (l = 5.03 m; w = 2.44 m; and h = 1270 mm). |

Thus to practice the present invention, it is first necessary to determine the values of the constants $k_1$ and $k_2$. The values of these constants $k_1$ and $k_2$ are reasonably accurate after a single determination, however if desired the determination may be repeated as often as desirable for a given species and the averages of the determined values for the constants $k_1$ and $k_2$ be use to implement the control as will be described below.

Once the values of the constants $k_1$ and $k_2$ have been determined, the technique for controlling the RFDH process (such as dry kiln) is to decide (based on prior experience) the moisture content of the dried product i.e. the moisture content MC as a % by oven-dry weight of the dried product desired for the next phase, if any, of the process and terminating the drying operation when the values of KW and KV meet the values for the selected moisture content as defined by Equations 1 and 2.

By adhering to the above design considerations and combining all these concepts with careful empirical measurements for a specific product and drying system design, we have disclosed an improved and potentially much more accurate method of determining the average moisture content of any type of wood product load 12 between 5% to 25% moisture content for any configuration of a RFDH process using frequencies between 3 MHz to 60 MHz.

In operation, this method permits accurate computer-controlled termination of the drying cycle. Once the drying cycle begins, the energy KW applied and the RF voltage KV applied through the 6 and 10 across the charge 12 are used to estimate the moisture content of the drying load with the required accuracy.

Having described this invention, modifications will be evident to those skilled in the art without departing from the scope of the invention as defined in the appended claims.

We claim:

1. A method of determining the moisture content of a moisture containing charge being subjected to Radio Frequency Dielectric Heating (RFDH) comprising determining package size of a charge of material by measuring its dimensions of package height h, package width w and package length l; subjecting said kiln charge to RFDH; measuring the RF power KW being applied in kilowatts (kW) to the charge through the electrode(s); measuring the RF voltage KV applied at the electrode(s) in kilovolts (kV); and determining the moisture content MC as % moisture in the charge when subjected to the measured conditions of RF power, RF voltage, and package dimensions based on a function of measured values of KW, KV, and package dimensions h, l and w and thereby defining said moisture content of said charge.

2. A method as defined in claim 1 wherein said moisture content is determined based on the relationships $$MC=k_1*f(DI)+k_2$$

and $$DI=KW*h/KV^2*l*w$$

Where:

KW=Measured RF power (in kW) being output from a RF generator into the electrode(s) and through the material.

KV=Measured RF voltage (in kV) at the electrode(s).

MC=Moisture content (in % by oven-dry weight), w=package width of material, l=package length of material, h=package height of material (more specifically, the distance between the electrode and electrical ground), $k_1$ and $k_2$ are constants determined for the particular material of the charge.

3. A method as defined in claim 2 wherein $f$(DI) is a log 10 function.

4. A method as defined in claim 3 wherein said radio frequency (RF) is in the range of 3 to 60 MHz.

5. A method as defined in claim 3 wherein, the RFDH system is operated with the charge subject to subatmospheric pressure.

6. A method as defined in claim 2 wherein said radio frequency (RF) is in the range of 3 to 60 MHz.

7. A method as defined in claim 6 wherein, the RFDH system is operated with the charge subject to subatmospheric pressure.

8. A method as defined in claim 2 wherein, the RFDH system is operated with the charge subject to subatmospheric pressure.

9. A method as defined in claim 1 wherein, the RFDH system is operated with the charge subject to subatmospheric pressure.

10. A method of controlling the operation of a process for Radio Frequency Dielectric Heating (RFDH) a charge comprising measuring the size of said charge to determine its dimensions of height h, width w and length l; subjecting the charge having a moisture content (in % by oven-dry weight) in the range of from 5% to 25% to RFDH; measuring the RF power KW being applied in kilowatts (kW) to the charge through electrode(s); measuring the RF voltage KV in kilovolts (kV) applied at the electrodes; and terminating the process cycle when the moisture content MC (as a percent by oven-dry weight of the charge) reaches a preselected value $MC_S$ as determined based on said measured values KW, KV, package dimesions h, l and w, and a predetermined function based on the measured values of KW, KV, and package dimensions h, l and w.

11. A method as defined in claim 10 wherein said function is based on the equations $$MC_S=k_1*f(DI)+k_2$$

and $$DI=KW*h/KV^2*l*w$$

Where:

KW=Measured RF power (in kW) being output from a RF generator into the electrode(s) and through the material.

KV=Measured RF voltage (in kV) at the electrode(s), w=package width of material, l=package length of material, h=package height of material (more specifically, the distance between the electrode and electrical ground), $MC_S$=the preselected moisture content (in % by oven-dry weight), $k_1$ and $k_2$ are predetermined constants for the material of the charge being processed.

12. A method as defined in claim 11 wherein $f$(DI) is a log 10 function.

13. A method as defined in claim 12 wherein said radio frequency (RF) is in the range of 3 to 60 MHz.

14. A method as defined in claim 12 wherein, the RFDH system is operated with the charge subject to subatmospheric pressure.

15. A method as defined in claim 11 wherein said radio frequency (RF) is in the range of 3 to 60 MHz.

16. A method as defined in claim 15 wherein, the RFDH system is operated with the charge subject to subatmospheric pressure.

17. A method as defined in claim 11 wherein, the RFDH system is operated with the charge subject to subatmospheric pressure.

18. A method as defined in claim 10 wherein said radio frequency (RF) is in the range of 3 to 60 MHz.

19. A method as defined in claim 18 wherein, the RFDH system is operated with the charge subject to subatmospheric pressure.

20. A method as defined in claim 10 wherein, the RFDH system is operated with the charge subject to subatmospheric pressure.

* * * * *